US006942757B1

(12) United States Patent
Iwama et al.

(10) Patent No.: US 6,942,757 B1
(45) Date of Patent: Sep. 13, 2005

(54) PROCESS FOR PREPARING PARA-AROMATIC POLYAMIDE PAPER

(75) Inventors: Masanobu Iwama, Ibaraki-Ken (JP); Tsutomu Takahashi, Ibaraki-Ken (JP)

(73) Assignee: Teijin Twaron B.V., Arnhem (NL)

( * ) Notice: Subject to any disclaimer, the term of this patent is extended or adjusted under 35 U.S.C. 154(b) by 0 days.

(21) Appl. No.: 08/647,996

(22) PCT Filed: Jul. 19, 1994

(86) PCT No.: PCT/EP94/02384

§ 371 (c)(1),
(2), (4) Date: Aug. 23, 1996

(87) PCT Pub. No.: WO95/14815

PCT Pub. Date: Jun. 1, 1995

(30) Foreign Application Priority Data

Nov. 29, 1993 (JP) ..... 5/298278

(51) Int. Cl.[7] ..... D21H 13/26
(52) U.S. Cl. ..... 162/157.3; 162/146; 162/206
(58) Field of Search ..... 162/146, 157.31, 162/206

(56) References Cited

U.S. PATENT DOCUMENTS 2,999,788 A * 9/1961 Winthrop ..... 162/146
3,068,527 A * 12/1962 Morgan ..... 162/146
3,671,542 A 6/1972 Kwolek ..... 260/30.8 R
4,752,355 A * 6/1988 Provost ..... 162/206
4,959,453 A 9/1990 Sweeny ..... 528/336
5,026,456 A 6/1991 Hesler et al. ..... 162/146
5,028,372 A * 7/1991 Brierre et al. ..... 162/157.3
5,076,887 A * 12/1991 Hendren ..... 162/206
5,223,094 A * 6/1993 Kirayoglu et al. ..... 162/157.3

FOREIGN PATENT DOCUMENTS

EP 0 572 002 A2 1/1993 ..... D01F 6/60

OTHER PUBLICATIONS

Abstract of Japanese Patent No. JP3039539 dated Jul. 6, 1989.
Abstract of Japanese Patent No. JP55014167 dated Jul. 17, 1978.
Abstract of Japanese Patent No. JP57017886 dated Jul. 7, 1980.
Abstract of Japanese Patent No. J5 9163-418-A dated Jan. 3, 1983.
International Serarch Report PCT/EP 94/02384 dated Dec. 22, 1994.

* cited by examiner

*Primary Examiner*—Peter Chin
(74) *Attorney, Agent, or Firm*—Oliff & Berridge, PLC

(57) ABSTRACT

A process for producing a paper made essentially of a para-aromatic polyamide and having agglutinate portions, the process including subjecting to papermaking a composition comprising at least one member selected from the group of short fibers, staple fibers, pulp and polymer particles of a para-aromatic polyamide swollen with water, and then drying the resulting wet paper under pressure, preferably after removal of free water attached thereto. The para-aromatic polyamide paper obtained has heat resistance and stiffness and also has a high breaking length. This paper is thus useful as an insulating paper and can also be made useful as a material for composite materials by imparting other functions to the paper.

16 Claims, No Drawings

PROCESS FOR PREPARING PARA-AROMATIC POLYAMIDE PAPER

BACKGROUND OF THE INVENTION

This invention relates to a process for preparing paper consisting essentially of a para-aromatic polyamide (referred to hereinafter as para-aramid in some cases). The para-aramid paper obtained by the process of this invention is useful particularly as insulating paper for composite materials having a honeycomb structure and the like in application fields requiring heat resistance and high strength.

Para-aramid fibres have excellent properties, such as high strength, high stiffness, and high heat resistance, and para-aramid pulp prepared from para-aramid fibres has been widely used as a substitute for asbestos. However, said para-aramid fibres do not melt and hence para-aramid paper prepared from said para-aramid pulp has no agglutinate portions (called entangled portions in some cases). Consequently, para-aramid paper has low strength and so is difficult to use as insulating paper and the like.

Extensive research was performed to solve the above problems. For example, Japanese Patent Application Kokai No. 59/163 418 discloses that the agglutinate portions between fibrils can be improved by using pulp obtained by fibrillating fibres consisting of para-aramid and aliphatic polyamide.

In Japanese Patent Application Kokoku No. 3/39 539, a sheet-like paper comprising para-aramid short fibres is also proposed for improving the heat resistance and strength of a paper composed of meta-aromatic polyamide (referred to hereinafter as meta-aramid in some cases). Extremely fine short fibres (called fibrils in some cases) are obtained by violently agitating a meta-aramid solution with high shearing in a non-solvent (usually an aqueous medium). Said fibrils agglutinate upon drying, and as a result meta-aramid paper comprising as an essential component fibrils composed of meta-aramid has a high strength. Since para-aramid fibres have a higher fibre strength than meta-aramid fibres, combining para-aramid short fibres with fibrils composed of meta-aramid will give paper having a higher strength and a higher heat resistance.

The above-mentioned system is one in which a component other than para-aramid is added in order to form agglutinate portions in para-aramid paper, and hence said other component adversely affects the high stiffness and high heat resistance characteristic of para-aramid fibres.

Japanese patent application Kokai No. 3/14 832 discloses a method for preparing para-aramid paper using as a binder a para-aramid fibrous gel composition consisting of para-aramid, an amide solvent, an alkaline earth metal, and N-methylpyrrolidine. However, the Examples thereof show that the breaking length is 0.34 lb/in/oz/yd$^2$ (corresponding to 0.18 km), which is only about twice as high as the breaking length of paper prepared from commercially available para-aramid pulp.

SUMMARY OF THE INVENTION

This invention aims to improve the mechanical strength of para-aramid paper consisting essentially of para-aramid. As mentioned above, in the prior art the main trend is that various binders are used to introduce agglutinate portions for the purpose of enhancing the paper strength. However, such addition means that the heat resistance and the high stiffness characteristic of the para-aramid are impaired.

In the case of paper prepared by subjecting commercially available para-aramid pulp to papermaking, its breaking length is 0.1 km or less. In the case of fibrils consisting of meta-aramid, the wet paper obtained by subjecting them to papermaking forms, when dried, agglutinate portions between the fibrils. The agglutinate portions are made stronger by subjecting the dried paper to calender rolling at a high temperature. As a result, the breaking length of paper consisting of meta-aramid becomes 3 to 12 km. On the other hand, in the case of commercially available para-aramid pulp no agglutinate portions are formed. If paper consisting essentially of para-aramid and having agglutinate portions could be prepared, this paper would have a high strength and yet retain the characteristic features of para-aramid.

It is an object of this invention to provide a process for preparing para-aramid paper consisting essentially of para-aramid and having excellent mechanical properties.

It is another object of this invention to provide a process for preparing para-aramid paper having a breaking length of 0.5 km or more.

Other objects and advantages of this invention will become apparent from the following description.

According to this invention, there is provided a process for preparing paper consisting essentially of a para-aromatic polyamide which comprises a composition comprising at least one member selected from the group consisting of short fibres, staple fibres, pulp, and polymer particles of a para-aromatic polyamide swollen with water being subjected to papermaking, and drying the thus obtained wet paper under pressure.

DETAILED DESCRIPTION OF THE INVENTION

The term "para-aromatic polyamide" or "para-aramid" used herein refers to a polyamide obtained by polycondensing a para-oriented aromatic diamine and a para-oriented aromatic dicarboxylic acid halide. Said polyamide consists essentially of recurring units in which an amide linkage is bonded to the aromatic ring in its para-position or corresponding orientation position (namely, orientation positions opposite to each other on the same axis or on parallel axes, for example, 4,4'-biphenylene, 1,5-naphthalene, 2,6-naphthalene, or the like), and includes specifically aromatic polyamides of the para-orientation type structure or a structure close thereto, for example, poly(paraphenylene terephthalamide), poly-(4,4'-benzanilide terephthalamide), poly (paraphenylene-4,4'-biphenylene dicarboxamide), poly (paraphenylene-2,6-naphthalene dicarboxamide), and the like.

In this invention, short fibres, staple fibres, pulp, and polymer particles of para-aramid swollen with water can be prepared by the method mentioned below.

For example, filaments are obtained by subjecting a spinning dope in which para-aramid is dissolved in sulphuric acid to dry-wet spinning (also known as air gap spinning) or wet-spinning, and thereafter to water washing and drying. In this case, the water swollen para-aramid short fibres to be used in this invention are obtained by cutting the filaments before drying. When a high shearing force is applied to the para-aramid short fibres by a pulp producing refiner or the like, pulp of para-aramid swollen with water is obtained. Alternatively, polymer particles of para-aramid swollen with water are obtained by precipitating the para-aramid polymer in water and then washing the resulting precipitate as described in the Examples of U.S. Pat. No. 3,671,542. The water swollen para-aramid in various forms thus obtained is an aggregate consisting of para-aramid and water, and this is converted to an aggregate consisting only of para-aramid upon drying. However, even if the dried aggregate is dispersed in water again, it cannot be returned to the water swollen state.

The water swollen para-aramid pulp to be used in this invention can also be prepared by immersing a para-aramid solution as prepared by the method described in Japanese Patent Application Kokuku No. 57/17 886 in an aqueous bath to coagulate the para-aramid into a film, water-washing the film, and then applying a high shearing force to the washed film by using a refiner or the like.

According to the following method, the water swollen para-aramid in various forms to be used in this invention can be prepared on a commercial scale at low cost: a spinning dope consisting of para-aramid having an inherent viscosity of 1.0 to 2.5 dl/g, a chloride of an alkali or alkaline earth metal, and a polar amide solvent is coagulated in an aqueous coagulating bath by the above-mentioned dry-wet type spinning or wet type spinning process to prepare filaments, after which the prepared filaments are subjected to the aftertreatment mentioned above.

The spinning dope of a conventional para-aramid is usually prepared by dissolving the para-aramid in sulphuric acid. However, this conventional para-aramid has an inherent viscosity of about 4.5 dl/g, and hence will precipitate during the polymerisation. It is therefore necessary to precipitate the para-aramid polymer in water, sufficiently wash the resulting precipitate, dry the same, and remove the resulting fine powder. Thus, in the above conventional case, it follows that para-aramid in the form of fine powder is dissolved in sulphuric acid to prepare the spinning dope mentioned above. The process for producing the spinning dope thus becomes longer and is commercially disadvantageous for that reason.

The filaments obtained by using the polymerisation mixture as such as the spinning dope and coagulating the spinning dope in an aqueous coagulating bath are processed in the above-mentioned manner before drying. By this method, water swollen para-aramid in the form of short fibres or pulp to be used in this invention is produced at low cost. Moreover, it is also possible to produce polymer particles in the same manner as above. In this case, pulp can also be prepared from a film in the same manner as mentioned above.

Wet paper is prepared by subjecting a composition comprising at least one of the above-mentioned forms of water swollen para-aramid as an essential component to papermaking.

Specifically included is a method for preparing wet paper which comprises dispersing in water the pulp of water swollen para-aramid mentioned above and short fibres obtained by cutting para-aramid filaments prepared by the method described in Japanese Patent Kokoku No. 55/14 167, and then subjecting the dispersion to conventional papermaking. Since the commercially available para-aramid short fibres, staple fibres, and pulp prepared by the method described in Japanese Patent Kokoku No. 55/14 167 are prepared from dried filaments, they are not returned to the water swollen state even if they are immersed in water.

In this case, the use of at least one member of the group of short fibres, staple fibres, pulp, and polymer particles of water swollen para-aramid to be used in this invention, preferably water swollen para-aramid short fibres or pulp, makes it possible to prepare para-aramid paper having agglutinate portions. The amount of short fibres, staple fibres, pulp, or polymer particles of water swollen para-aramid used can be varied depending upon the strength, density, and smoothness of the desired paper.

Unless the wet paper has a certain paper strength, its handling in the production process after papermaking becomes difficult. For example, when paper is made from a composition comprising polymer particles of water swollen para-aramid and dried short fibres, the wet paper obtained has a too low strength and hence its handling after papermaking becomes difficult. Accordingly, the composition must be selected taking into consideration the paper strength of wet paper in the production process. Basically, the larger the amount of water swollen para-aramid in the above-mentioned form added, the greater the amount of agglutinate portions in the paper will be. In this case, however, the density is also increased. Speaking of the quality of the paper, the greater the amount of agglutinate portions and the longer the short fibres, staple fibres, or pulp, the higher the paper strength will be, with the proviso that it becomes difficult to obtain paper having a uniform paper quality when the fibre length of the short fibres and the staple fibres is increased.

In this invention, wet paper is prepared by dispersing short fibres or the like of water swollen para-aramid in water and sub-jecting the dispersion to papermaking in a conventional manner. In this proces, a conventional papermaking machine can be used. Although it is possible to carry out the papermaking in a vat, in industry a paper machine with a wire and a cylinder can be used, as well as a paper machine equipped with a loft-former.

Wet paper in the form of a sheet obtained by papermaking is dried as it is under pressure. The drying is preferably by heating. Also, it is preferable to first remove the free water attached to the wet paper and then dry the paper under pressure, since in this way para-aramid paper of excellent texture and paper strength can be obtained.

When only one pair of rolls is used, the above-mentioned purpose can be achieved by sandwiching the wet paper between upper and lower metal foils or heat resistant resin films and heat-drying the assembly under pressure, or by a two-step calendering method comprising first calendering the wet paper at room temperature and then calendering the same at a high temperature. When the multistep calendering method is used, it is possible to dry the wet paper under pressure while continuously removing the free water by varying the roll temperature in each step. The heat drying conditions preferably are such that drying is effected, under pressure, at a temperature of 80° C. or more to produce para-aramid paper having agglutinate portions. When the temperature is less than 80° C., a longer drying time is required, and hence such a temperature is disadvantageous in industry.

The drying conditions in industrial scale production, namely temperature and pressure, are determined depending upon the density, strength, and the like of the desired para-aramid paper. For example, the temperature and pressure conditions during the so-called calendering process preferably are 130° C. or more and 50 kg/cm or more. When the pressure during drying is too low, sufficient agglutinate portions cannot be obtained and the breaking length of the paper becomes low.

The production process of this invention makes it possible to produce para-aramid paper consisting essentially of para-aramid and having a breaking length of 0.5 km or more, preferably 1.0 km or more, though the breaking length may be varied depending upon the para-aramid's form and proportion.

The para-aramid paper obtained by the process of the invention can be used as insulating paper. When the para-aramid paper is used as insulating paper, micas, ground quartz, glass fibres, alumina, talc, and the like can be incorporated into the paper to improve its insulating properties. On the other hand, alumina laminae, carbon black, stainless steel short fibres, or the like may be incorporated into the para-aramid paper to give it electrical conductivity.

Other uses include the para-aramid paper prepared by the process of this invention being used as a reinforcing material in composite materials having a honeycomb structure. Also, the para-aramid paper can be used in particled boards and the like serving as a substrate for adiabatic and fire-proofing walls.

DESCRIPTION OF PREFERRED EMBODIMENTS

This invention is explained in detail below with reference to Examples and Comparative Examples. The test method, the evaluation method, and the evaluation criteria in the Examples and Comparative Examples were as stated below.

(1) Method of Measuring Inherent Viscosity

The flow time of a solution of 0.5 g of para-aramid in 100 ml of 96–98% sulphuric acid and of 96–98% sulphuric acid per se was measured with a capillary viscometer at 30° C., and the inherent viscosity was determined from the ratio between the two flow times according to the following equation:

$$\text{Inherent viscosity}=\ln(T/T_o)/C \text{ [unit: dl/g]}$$

wherein T and $T_o$ are the flow time of the para-araramid solution in sulphuric acid and the flow time of the sulphuric acid, respectively, and C is the concentration of the para-aramid solution (g/dl).

(2) Specific Surface Area

The specific surface area ($m^2/g$) of the para-aramid pulp was determined with the aid of the BET specific surface area method from the amount of adsorbed nitrogen measured using Flowsoap II2300 manufactured by Micromeritics.

(3) Breaking Length

The breaking length was determined with an Instron tensile tester in accordance with JIS P8113.

(4) Observation of Agglutinate Portions (Entangled Portions)

Using a scanning type electron microscope (SEM) manufactured by Hitachi Limited, the agglutinate portions of the para-aramid paper were observed. In those cases where, in the portions in which the para-aramid short fibres or pulp fibres contact one another, their interface was not observed at a magnification of 5000, there was judged to be an agglutinate portion.

SYNTHESIS EXAMPLE 1

Preparation of Para-aramid Short Fibres

Short fibres of water swollen poly(paraphenylene terephthalamide) were prepared by the following method:

Polymerisation

In a 500 ml separable flask equipped with an agitating blade, a thermometer, a nitrogen-introducing tube, and a powder-feeding inlet, poly (paraphenylene terephthalamide) was prepared.

After the flask had been sufficiently dried, 300 g of NMP (N-methyl pyrrolidone) and 0.135 mole of dried calcium chloride were placed in the flask, and the calcium chloride was completely dissolved in NMP at an internal temperature of 85° C. Subsequently, 0.120 mole of paraphenylene diamine (referred to hereinafter as PPO in some cases) was added to the solution, and the contents of the flask were cooled to an internal temperature of −6° C., after which 0.115 mole of terephthaloyl chloride (referred to hereinafter as TPC in some cases) was gradually added thereto while the internal temperature was kept at 5° C. or less. After completion of the addition of TPC, ageing was effected at a temperature of −6° to 0° C. for two hours to obtain a stable, liquid polymer dope. The inherent viscosity of the poly (paraphenylene terephthalamide) was 1.8 dl/g.

Spinning

The liquid polymer dope of para-aramid thus obtained was spun and coagulated in an aqueous solution containing 20% by weight of NMP. The spinning nozzle used had a cone-shaped hole with a cylindrical end, the L/D of the cylindrical hole portion being 1 and the hole diameter in this portion being 0.07 mm. After spinning, the filaments obtained were sufficiently washed with water and then cut to a fibre length of about 6 mm to obtain short fibres of water swollen para-aramid. A portion of the short fibres was sampled and dried at 120° C. for two hours to establish their solids content, which was about 20% by weight.

SYNTHESIS EXAMPLE 2

Preparation of Pulp

In the same manner as in Synthesis Example 1, filaments of water swollen para-aramid were obtained. Subsequently, the water swollen para-aramid filaments were cut to a fibre length of about 30 mm, and the fibres thus obtained were pulped in a PFI mill manufactured by Kumagai Riki Kogyo K. K. The pulp thus obtained was in the wet state, and dispersed as such in water and stored. A portion of the pulp was sampled, dried, and measured for specific surface area, which turned out to be about 2 $m^2/g$. The solids content was about 20% by weight.

EXAMPLE 1

The free water attached to the short fibres of water swollen para-aramid obtained in Synthesis Example 1 was sufficiently removed, and 30 g of the short fibres were dispersed in 1.5 liters of deionized water. The dispersion was subjected to beating using a standard pulper manufactured by Kumagai Riki Kogyo K. K. and then to papermaking using a standard square-shaped sheet machine manufactured by Kumagai Riki Kogyo K. K. Three sheets of wet paper thus obtained were placed one on top of the other, and the resulting assembly was heated by a hot press and dried under pressure. The drying conditions in the hot press were 150° C., 100 $kg/cm^2$, and three minutes. Thus, para-aramid paper consisting essentially of para-aramid was obtained. The areal weight of the para-aramid paper was 221 $g/m^2$, the breaking length 0.98 km. SEM observation of the para-aramid paper showed flattened para-aramid short fibres and many agglutinate portions in which the fibre interface between different fibres was not clear.

EXAMPLE 2

The same procedure as in Example 1 was repeated, except that 6 g of Twaron pulp, the para-aramid pulp manufactured by Akzo Nobel N.V. were compounded with 60 g of the short fibres of water swollen para-aramid obtained in Synthesis Example 1, to obtain para-aramid paper. One sheet of the wet paper was hot pressed and, separately, two sheets and twelve sheets of the wet paper were placed one on top of the other, whereupon the resulting assembly was hot pressed. Thus, three kinds in total of para-aramid paper were prepared.

The areal weights of the three kinds of para-aramid paper were 196 g/m$^2$, 341 g/m$^2$, and 517 g/m$^2$. In the SEM observation it was found that fibrils of Twaron were embedded in the water swollen para-aramid short fibres, the interface disappeared partially, and agglutinate portions were formed.

EXAMPLE 3

To two liters of deionized water were added 27 g (solids content: 3 g) of the pulp of water swollen para-aramid obtained in Synthesis Example 2, from which the free water had been sufficiently removed, as well as 2 g of short fibres (fibre length: 3 mm) of Twaron fibres (para-aramid fibres manufactured by Akzo Nobel N.V.). The resulting mixture was subjected to beating for eight minutes using the same pulper as used in Example 1, and then to papermaking using the same paper machine as in Example 1. The resulting wet paper was sandwiched between two sheets of copper foil having a thickness of 35 $\mu$m, and the resulting assembly was hot calendered under pressure with the aid of two small-size rolling mills manufactured by Kabushiki Kaisha Daito Seisakusho. In this case, the roll temperature was 165° C. and the roll gap was 120 $\mu$m.

The areal weight of the para-aramid paper thus obtained was 70 g/m$^2$ and the breaking length was 3.0 km. SEM observation of the para-aramid paper showed that agglutinate portions in which the fibre interface between the para-aramid pulp and the Twaron short fibres was not clear were present all over the paper.

EXAMPLE 4

To 1300 ml of deionized water were added 1.6 g of short fibres of Twaron para-aramid fibre (fibre length: 6 mm) of Akzo Nobel N.V., and the resulting mixture was treated by a home mixer for three minutes. There were further added 25 g (solids content: 3.5 g) of the water swollen pulp obtained in Synthesis Example 2, from which the free water had been sufficiently removed, and 700 ml of deionized water, and the resulting mixture was subjected to beating and papermaking in the same manner as in Example 3. The wet paper thus obtained was subjected to hot calendering under pressure in the same manner as in Example 3. However, in this case, the wet paper was first calendered at room temperature (roll gap: 85 $\mu$m) to remove the free water and then calendered at 165° C. (roll gap: 100 $\mu$m). The areal weight of the para-aramid paper thus obtained was 80 g/m$^2$ and the breaking length was 3.0 km. SEM observation of the para-aramid paper showed that agglutinate portions in which the fibre interface between the para-aramid pulp and the Twaron short fibres was not clear were present all over the paper.

EXAMPLE 5

To deionized water were added 46 g (solids content: 2.7 g) of para-aramid polymer particles obtained by precipitating the para-aramid liquid polymer dope prepared in Synthesis Example 1 in deionized water, pulverising the resulting precipitate to an average particle size of about 120 $\mu$m using an autohomomixer manufactured by Tokushu Kika Kogyo K. K. and the same home mixer as in Example 4, and sufficiently removing the free water therefrom by suction filtering; 3.7 g (solids content: 0.5 g) of the water swollen para-aramid pulp obtained in Synthesis Example 2, from which the free water had been sufficiently removed; and 1.5 g of Twaron short fibres (fibre length: 3 mm). The resulting mixture was subjected to papermaking in the same manner as in Example 3, except that the beating time was three minutes. The wet paper thus obtained was hot calendered under pressure in the same manner as in Example 3, with the proviso that the roll temperature was 160° C. and the roll gap was 140 $\mu$m.

The areal weight of the para-aramid paper thus obtained was 79 g/m$^2$ and the breaking length was 3.7 km. SEM observation of the para-aramid paper showed that agglutinate portions in which the fibre interface among the polymer particles of para-aramid, the Twaron short fibres, and the para-aramide pulp was not clear were present all over the paper.

COMPARATIVE EXAMPLE 1

The same procedure as in Example 1 was repeated, except that 30 g of the para-aramid pulp obtained in Synthesis Example 2 were used and the wet paper obtained was dried in a hot oven without being subjected to hot pressing. The dry paper obtained had a breaking length of 0.11 km. No definite agglutinate portions were confirmed by SEM observation.

COMPARATIVE EXAMPLE 2

The same procedure as in Comparative Example 1 was repeated, except that 6 g of Twaron 1097 having a specific surface area of about 6 m$^2$/g were substituted for the para-aramid pulp to obtain dry paper. The breaking length thereof was 0.08 km.

What is claimed is:

1. A process for producing paper consisting essentially of a para-aromatic polyamide which comprises subjecting to papermaking a composition comprising at least one member selected from the group consisting of short fibers, staple fibers, pulp, and polymer particles of a para-aromatic polyamide swollen with water, and then drying the resulting wet paper under pressure, wherein the pressure during the drying corresponds to a calendering pressure of at least 50 kg/cm.

2. The process according to claim 1, wherein short fibers, staple fibers, pulp, and polymer particles of a para-aromatic polyamide swollen with water are obtained by treating filaments obtained by coagulating a spinning dope consisting of a para-aromatic polyamide having an inherent viscosity of 1.0 to 2.5 dl/g, a chloride of an alkali or alkaline earth metal, and a polar amide solvent in an aqueous coagulating bath.

3. The process according to claim 1, wherein the drying is conducted at a temperature of 80° C. or more.

4. The process according to claim 1, wherein the drying is conducted by calendering at a temperature of 130° C. or more at a pressure of 50 kg/cm or more.

5. The process according to claim 1, wherein the wet paper is subjected to removal of the free water attached thereto and thereafter dried under pressure.

6. The process according to claim 1, wherein the para-aromatic polyamide is poly (paraphenylene terephthalamide), poly(4,4'-benzanilide terephthalamide), poly (paraphenylene-4,4'-biphenylene dicarboxamide), or poly (paraphenyle-ne-2,6-naphthalene dicarboxamide).

7. The process according to claim 1, wherein at least one member of a para-aromatic polyamide swollen with water is short fibers or pulp.

8. A paper consisting essentially of a para-aromatic polyamide prepared in accordance with the process of claim 1, having a breaking strength of 0.5 km or more.

9. The process according to claim 1, wherein the pressure during the drying is applied with rolls.

10. The process according to claim 1, wherein the composition subjected to papermaking does not contain meta-aramid.

11. The paper according to claim 8, wherein the paper has agglutinate portions.

12. The process according to claim 1, wherein the drying is conducted by hot pressing at a pressure of 100 kg/cm$^2$.

13. A process for producing para-aromatic polyamide paper that comprises subjecting to papermaking a composition consisting essentially of short fibers of a para-aromatic polyamide swollen with water, and then drying the resulting wet paper under pressure, wherein the pressure during the drying corresponds to a calendering pressure of at least 50 kg/cm.

14. A process for producing para-aromatic polyamide paper that comprises subjecting to papermaking a composition consisting essentially of short fibers and pulp of a para-aromatic polyamide swollen with water, and then drying the resulting wet paper under pressure, wherein the pressure during the drying corresponds to a calendering pressure of at least 50 kg/cm.

15. A process for producing para-aromatic polyamide paper that comprises subjecting to papermaking a composition consisting essentially of pulp of a para-aromatic polyamide swollen with water, and then drying the resulting wet paper under pressure, wherein the pressure during the drying corresponds to a calendering pressure of at least 50 kg/cm.

16. A process for producing para-aromatic polyamide paper that comprises subjecting to papermaking a composition consisting essentially of short fibers, pulp, and polymer particles of a para-aromatic polyamide swollen with water, and then drying the resulting wet paper under pressure, wherein the pressure during the drying corresponds to a calendering pressure of at least 50 kg/cm.

* * * * *

UNITED STATES PATENT AND TRADEMARK OFFICE

CERTIFICATE OF CORRECTION

PATENT NO. : 6,942,757 B1
DATED : September 13, 2005
INVENTOR(S) : Masanobu Iwama and Hideaki Takahashi It is certified that error appears in the above-identified patent and that said Letters Patent is hereby corrected as shown below:

Column 1,
Lines 54 and 56, change “length” to -- strength --.

Column 2,
Lines 8 and 19, change “length” to -- strength --.

Column 3,
Lines 16 and 25-26, change “inherent” to -- intrinsic --.

Column 4,
Lines 60, 64 and 65, change “length” to -- strength --.

Column 5,
Lines 23, 27 and 31, change “inherent” to -- intrinsic --;
Line 42, change “Length” to -- Strength --; and
Line 43, change “length” to -- strength --.

Column 6,
Line 6, change “PPO” to -- PPD --;
Line 14, change “inherent” to -- intrinsic --;
Line 63, change “areal” to -- specific --; and
Line 64, change “length” to -- strength --.

Column 7,
Lines 13, 39 and 62, change “areal” to -- specific --; and
Lines 40 and 63, change “length” to -- strength --.

UNITED STATES PATENT AND TRADEMARK OFFICE

CERTIFICATE OF CORRECTION

PATENT NO. : 6,942,757 B1
DATED : September 13, 2005
INVENTOR(S) : Masanobu Iwama and Hideaki Takahashi It is certified that error appears in the above-identified patent and that said Letters Patent is hereby corrected as shown below:

Column 8,
Line 21, change “areal” to -- specific --; and
Lines 22 and 44, change “length” to -- strength --.

Signed and Sealed this

Fifteenth Day of November, 2005

JON W. DUDAS
*Director of the United States Patent and Trademark Office*